US005149597A

United States Patent [19]

Holko

[11] Patent Number: 5,149,597

[45] Date of Patent: Sep. 22, 1992

[54] WEAR RESISTANT COATING FOR METALLIC SURFACES

[76] Inventor: Kenneth H. Holko, 7384 Trade St., San Diego, Calif. 92121-2422

[21] Appl. No.: 704,741

[22] Filed: Jan. 5, 1990

Related U.S. Application Data

[63] Continuation-in-part of Ser. No. 308,608, Feb. 10, 1989, abandoned.

[51] Int. Cl.[5] ..... B32B 15/00; C22C 19/05

[52] U.S. Cl. ..... 428/680; 428/679; 75/255; 420/452

[58] Field of Search ..... 428/553, 680, 679, 937; 75/255; 420/442, 452

[56] References Cited

U.S. PATENT DOCUMENTS

| | | | |
|---|---|---|---|
| 2,744,009 | 5/1956 | Bowne et al. | 420/452 |
| 3,155,491 | 11/1964 | Hoppin et al. | 420/442 |
| 3,230,097 | 1/1966 | Fischer | 75/255 |
| 3,246,981 | 4/1966 | Quass et al. | 75/255 |
| 3,305,326 | 2/1967 | Longo | 75/255 |
| 3,938,814 | 2/1976 | Cromwell | 428/937 |
| 4,136,230 | 1/1979 | Patel | 429/937 |
| 4,283,225 | 8/1981 | Sexton | 420/452 |
| 4,325,994 | 4/1982 | Kitashima et al. | 428/679 |
| 4,379,121 | 4/1983 | McMurray et al. | 420/442 |
| 4,381,944 | 5/1983 | Smith et al. | 75/255 |
| 4,389,251 | 6/1983 | Simm et al. | 428/937 |
| 4,401,724 | 8/1983 | Moskowitz et al. | 428/937 |
| 4,594,103 | 6/1986 | Simm et al. | 420/452 |
| 4,671,932 | 6/1987 | Lutz et al. | 75/255 |
| 4,745,037 | 5/1988 | De Cristofaro et al. | 428/679 |
| 4,754,950 | 7/1988 | Tada et al. | 428/679 |
| 4,830,934 | 5/1989 | Ferrigno et al. | 428/680 |

FOREIGN PATENT DOCUMENTS

| | | | |
|---|---|---|---|
| 3018007A1 | 11/1981 | Fed. Rep. of Germany | 75/255 |
| 60-245770 | 12/1985 | Japan | 420/452 |

*Primary Examiner*—John Zimmerman
*Attorney, Agent, or Firm*—H. Jay Spiegel

[57] ABSTRACT

The present invention relates to a wear resistant coating for metallic surfaces and the method of applying the coating. The coating consists of two nickel-based materials mixed together in a predetermined ratio and then dusted on the surface which use to be treated. The coating is metallically bonded to the metallic surface by heating through a sequence of heating steps. The inventive coating has achieved a hardness of up to Rc59.

5 Claims, 1 Drawing Sheet

WEAR RESISTANT COATING FOR METALLIC SURFACES

This application is a continuation-in-part of Ser. No. 308,608, filed Feb. 10, 1989, now abandoned.

BACKGROUND OF THE INVENTION

Often, a metal part or component is used in a manner which requires it to rub against an adjacent hard surface. In such an environment of use, frequently, the metallic part or component wears rapidly to the point of galling and small pieces of the metallic part or component may come off resulting in damage to adjacent structures, reduction in the life of the part or component and other detrimental effects.

As such, a need has developed for a wear resistant coating which may be applied on a metallic surface, which coating has a greater degree of hardness and lubricity than the metallic surface on which it is applied. With such a wear resistant coating so applied, wear of the metallic surface can be significantly retarded thereby resulting in increased life of the part or component having the said metallic surface.

As such, a need has developed for a wear resistant coating which may be applied to such a metallic surface to protect the surface when it is engaging adjacent hard surfaces so as to prevent galling or other wear and thus increase the life thereof.

In the past, ceramic coatings for metallic parts and components have been tried without great success. It has been found that the melting point of the ceramics is generally higher than that of the base metal on which the ceramic is being applied, therefore, the application process generally resulted in destruction of the metallic part or component not to mention its temper. Furthermore, even if one could be successful at coating a ceramic on a metallic part or component, such ceramic coating would not tolerate any bending or flexure of the metallic part or component since such bending or flexure would result in cracking of the coating.

Other types of coatings have been tried including combinations of methylmethacrylate and ceramics. While results from the use of this combination of materials for a coating are better than through the use of a ceramic alone, it has been found that adherence of a coating made from these constituent parts is inferior. Even the milling of grooves in a metallic part or component would not adequately solve the problem. As such, a need has developed for a coating which may be applied on a metallic part or component which will adhere to the base metal while providing a surface of increased hardness to thereby protect the base metal and therefore increase the life and durability of the metallic part or component.

SUMMARY OF THE INVENTION

The present invention relates to a wear resistant coating for metallic surfaces and the method of applying the coating. The inventive coating includes the following aspects:

a) The first constituent material which is used in the present invention consists of a brazing alloy in a fine powder form, the alloy being made up of, by weight, 14% percent Chromium, 0.1% Silicon, 0.2% Iron, 10% Phosphorus and the balance Nickel. One example of such an alloy is known by the trademark NICROBRAZ 50, a trademark of the Wall Colmonoy Corporation.

b) The inventive coating material is prepared by mixing the above described brazing alloy with a further brazing alloy in fine powder form which is made up of, by weight, 3.5% Silicon, 1.9% Boron, 1.5% Iron and the balance Nickel Examples of this further brazing alloy are known by the trademarks NICROBRAZ 135 owned by the Wall Colmonoy Corporation and AMDRY 790 owned by Alloy Metals, Inc.

c) For optimal results, the two above mentioned brazing alloy powders are mixed together in the ratio of 80% of the first mentioned brazing alloy powder and 20% of the second mentioned brazing alloy powder. For optimal results, the powdery nature of the alloys should be to a particle size of −325 mesh or finer.

d) In the method of coating metallic surface with the inventive coating, the surface is first carefully cleaned and is then coated with a binder material. Thereafter, the coating material is dusted onto the surface and adheres thereto due to the presence of the binder Thereafter, the coating is metallically bonded to the metallic surface by heating to the melting temperature of the coating material in a series of heating steps, preferably performed in a vacuum furnace.

Accordingly, it is a first object of the present invention to provide a new and improved coating material designed to provide wear resistance for metallic surfaces.

It is a further object of the present invention to provide such a coating material which may be coated onto a metallic surface by following the methods described herein.

It is a yet further object of the present invention to provide such a method which results in the coating being metallurgically bonded to the metallic surface which is being coated thereby.

These and other objects, aspects and features of the present invention will be better understood from the following detailed description of the preferred embodiments when read in conjunction with the appended photomicrograph.

BRIEF DESCRIPTION OF THE DRAWINGS

The sole Figure consists of a photomicrograph of a metallic substrate coated with the coating of the present invention through use of the method disclosed herein, at 500× magnification.

SPECIFIC DESCRIPTION OF THE PREFERRED EMBODIMENTS

Figure 1:
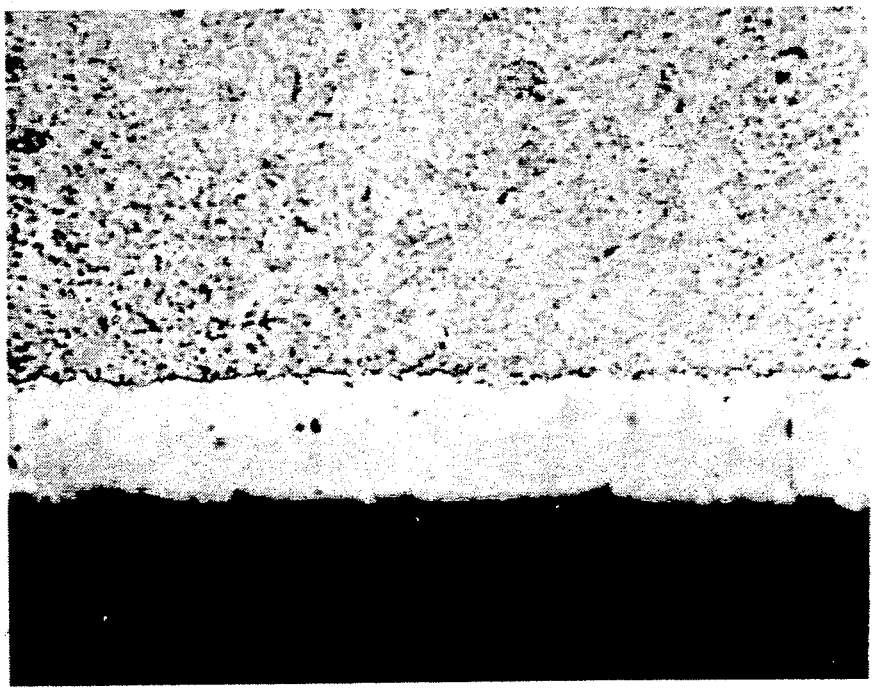

As noted hereinabove, the coating material is made up of two brazing alloys, provided in a powder form of extremely fine particle size of −325 mesh or finer. Constituent A better known as NICROBRAZ 50 consists of, by weight, 14% Chromium, 0.1% Silicon, 0.2% Iron, 10% Phosphorous and the balance Nickel. Constituent B better known as either NICROBRAZ 135 or AMDRY 790 consists of, by weight, 3.5% Silicon, 1.9% Boron, 1.5% Iron and the balance Nickel.

In the preferred embodiment of the present invention the coating material is formed by mixing together 80% by weight of constituent A and 20% by weight of constituent B. While this is the optimal ratio of constituents A and B which are mixed together to form the coating material of the present invention, in fact, one may use between 55% and 90%, by weight, of constituent A and, correspondingly, 10% to 45% by weight of constituent B.

The use of constituent A as a part of the coating material for iron base metallic surfaces is highly unusual due to the resulting formation of hard, brittle compounds. Constituent A is used as a portion of the coating material to provide excellent wear resistance.

With the preferred embodiment of the coating material having been described, the method of coating a metallic surface using the coating material will now be described in detail. The preferred steps are the following:

1) First, the metallic surface to be coated must first be carefully cleaned to remove all dirt, grease, oil, mill scale, oxides, paint and any other residue from prior processing or other sources. In the example wherein the surface to be coated consists of a surface of precipitation hardened stainless steel or 300 or 400 series stainless steel, the cleaning procedure consists of first cleaning the surface to be coated with acetone and thereafter immersing the surface in an acid bath at room temperature for approximately two minutes. In the preferred method, the acid bath which is employed includes, by volume, 12.5 to 25% $HNO_3$, 2.5 to 5% HF and the balance $H_2O$. Immersing in the acid bath allows the acid to etch the surface of the material to be coated while the acid also removes a small amount of material, usually less than one thousandth of an inch, which material includes any surface contaminants.

2) After the surface to be coated has been cleaned, the surface is thereafter coated with a binder material which will remain sticky or which will not dry out for at least several hours. Furthermore, the binder material must be a material which does not contaminate the coating material which is applied thereover later in the processing. One example of a binder material which may be used in accordance with the teachings of the inventive method consists of a binder composition including 75% by volume acetone and 25% by volume Cereclor 42. The binder material may be applied over the surface to be coated either by brushing on the binder material, by spraying the binder material in solution form with compressed air through a nozzle or by dipping the surface to be coated in a container of binder.

3) Thereafter, the coating material described hereinabove may be dusted onto the surface to be coated over the binder material and the coating material will adhere to the surface due to the presence of the binder. As stated hereinabove, for Optimal results, the coating material is provided in the form of an extremely fine powder having a particle size of no more than −325 mesh.

4) Thereafter, the coating is metallurgically bonded to the metallic surface in a vacuum furnace with the part having the coated surface being supported by non-metallic supports such as, for example, ceramic supports. Effective results have been obtained when the vacuum furnace is operated at a vacuum level of $1\times10^{-4}$ torr. The following is the preferred furnace cycle which should be used in obtaining optimal metallurgical bonding of the coating material on the metallic surface:

STEP 1: Heat to 700–800 degrees F. and hold for 15–25 minutes to drive binder off.

STEP 2: Heat to 1500–1550 degrees F. and hold for 15–25 minutes to stabilize temperatures in the furnace.

STEP 3: Heat rapidly to 1650–1670 degrees F. and hold for between 5 and 10 minutes to accomplish melting and bonding of the coating material on the metallic surface. When the ratio of Constituent A and Constituent B is at the preferred ratio of 80% to 20%, this step may be carried out at temperatures of up to 1850 Degrees F for a time period of up to 15 minutes.

STEP 4: Cool the furnace. One way of cooling the furnace is by back filling with inert gas. For hardenable alloys, an internal fan may be used to rapidly cool coated components and develop base metal strength. For non-hardenable alloys, furnace cooling is acceptable.

For optimal results, the component which is to be coated must be supported within the furnace in a flat position to avoid running and uneven buildup of the coating material. As stated above, the component must be supported in a manner preventing touching of other metallic surfaces to avoid joining. This may be accomplished, again, through the use of ceramic supports with the ceramic being made from $AL_2O_3$ or combinations of $AL_2O_3$ and $SiO_2$.

Use of a vacuum furnace is made to avoid oxidation of the coating and substrate. Alternatively, the heating may be accomplished in a high purity inert gas atmosphere or a high purity reducing atmosphere such as one including hydrogen.

As should be understood, during melting of the coating and alloying with the component surface, intermetallic compounds such as silicides, borides, phosphides and carbides are formed in the coating. These compounds are extremely hard and give the coating its high hardness and wear resistance.

Coatings have been carried out in accordance with the above described method of coating. Coating hardness of up to Rc59 has been measured with coating thicknesses of one to two thousandths of a inch being measured. The hardness of Rc59 is obtained through conversion from DPH microhardness. The photomicrograph comprising FIG. 1 shows high quality metallurgical bonding of the coating to the metallic substrate on which it has been coated. As shown in the Figure, the coating is quite uniform, has high quality, and adherence is excellent.

Wear tests on guided, reciprocating substrates which have been coated in accordance with the teachings of the present invention show that the coating is quite capable of protecting the side faces of the substrate against galling while increasing life span. In this regard, the coating has been found to have a high degree of lubricity due to the composition of the alloy. This lubricity inherently reduces friction between slidingly engaging parts. The coating has shown no significant wear after experiencing sliding engagement with a stainless steel guide device. Due to the reduced wear and friction, heating of the substrate is significantly reduced.

In a further aspect, a substrate such as that which is shown in FIG. 1 as coated in accordance with the teachings of the present invention was bent through 90 degrees around a one quarter inch diameter mandrill without any cracking of the coating taking place. This is considered to be excellent ductility for a coating of this type.

The substrate must be supported during firing in the vacuum furnace so that excessive coating buildup does not occur. This requires that a portion of the coated surface may come in contact with support means for the substrate during melting and bonding. Accordingly, the support means should comprise a thin aluminum oxide tool which will not bond to the coating.

Of course, the inventive coating may be used to coat any metallic part or component which, in operation, comes into sliding or other contact with other metallic parts or components to reduce friction, increase durability and thereby increase life span.

As such, an invention has been disclosed in terms of a coating and the method of coating a metallic substrate with the coating which fulfills each and every one of the objects of the present invention as set forth hereinabove and provides an effective way of treating and protecting a metallic part or component. Of course, various changes, modifications and alterations in the teachings of the present invention may be contemplated by those skilled in the art without separating from the intended spirit and scope thereof. As such, it is intended that the present invention only be limited by the terms of the appended claims.

I claim:

1. In a substrate having at least one surface thereon slidably engageable with guide means therefor, the improvement comprising a hard and lubricious coating, said coating comprising a nickel based alloy including, by weight at least 1% Phosphorus, 1% Chromium and 0.1% Boron, said nickel based alloy comprising first and second alloys mixed together and coated on said substrate, said first alloy including, by weight, approximately 14% Chromium, 0.1% Silicon, 0.2% Iron, 10% Phosphorus and the balance Nickel, and said second alloy including, by weight, approximately 3.5% Silicon, 1.5% Iron, 1.9% Boron and the balance Nickel.

2. The invention of claim 1, wherein said nickel based alloy includes, by weight, at least 75% Nickel.

3. The invention of claim 1, wherein said at least one surface comprises first and second surfaces defining opposed faces of said substrate.

4. The invention of claim 1, wherein said nickel based alloy includes 55–90% of said first alloy and 10–45% of said second alloy.

5. The invention of claim 4, wherein said nickel based alloy includes 80% of said first alloy and 20% of said second alloy.

* * * * *